US011834866B2

(12) United States Patent
Lammers et al.

(10) Patent No.: US 11,834,866 B2
(45) Date of Patent: Dec. 5, 2023

(54) FLEXIBLE COUPLING FOR ELECTRONIC DEADBOLT SYSTEMS

(71) Applicant: Amesbury Group, Inc., Amesbury, MA (US)

(72) Inventors: Tracy Lammers, Sioux Falls, SD (US); Douglas John Criddle, Sioux Falls, SD (US)

(73) Assignee: Amesbury Group, Inc., Edina, MN (US)

( * ) Notice: Subject to any disclaimer, the term of this patent is extended or adjusted under 35 U.S.C. 154(b) by 1049 days.

(21) Appl. No.: 16/664,144

(22) Filed: Oct. 25, 2019

(65) Prior Publication Data

US 2020/0141155 A1 May 7, 2020

Related U.S. Application Data

(60) Provisional application No. 62/756,356, filed on Nov. 6, 2018.

(51) Int. Cl.
*E05B 47/00* (2006.01)

(52) U.S. Cl.
CPC .... *E05B 47/0001* (2013.01); *E05B 2047/002* (2013.01); *E05B 2047/0031* (2013.01)

(58) Field of Classification Search
CPC ..... E05B 47/0001; E05B 2047/002; E05B 2047/0031; E05B 2047/0023; E05B 47/026; E05B 47/0012; Y10T 70/7062; Y10T 70/7102; Y10T 70/7107; Y10T 70/7113; Y10T 70/7119; Y10T 70/7124; Y10T 70/5367; Y10T 292/1082; Y10T 292/1094
See application file for complete search history.

(56) References Cited

U.S. PATENT DOCUMENTS 333,093 A 12/1885 Wright
419,384 A 1/1890 Towne
(Continued)

FOREIGN PATENT DOCUMENTS

AU 84928 12/2020
CA 2631521 11/2009
(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.
(Continued)

*Primary Examiner* — David R Hare
*Assistant Examiner* — Emily G. Brown
(74) *Attorney, Agent, or Firm* — Merchant & Gould P.C.

(57) ABSTRACT

An electronic deadbolt includes a housing, a deadbolt configured to extend or retract from the housing, and a drive system disposed at least partially within the housing. The drive system includes an electric motor and a leadscrew coupled between the electric motor and the deadbolt. The leadscrew is rotatable about a longitudinal axis so as to dive movement of the deadbolt. The drive system also includes a flexible coupling disposed between the electric motor and the leadscrew and is configured to absorb torsional loads generated by the movement of the deadbolt.

17 Claims, 6 Drawing Sheets

(56) References Cited

U.S. PATENT DOCUMENTS 651,947 A 6/1900 Johnson
738,280 A 9/1903 Bell et al.
932,330 A 8/1909 Rotchford
958,880 A 5/1910 Lawson
966,208 A 8/1910 Hoes
972,769 A 10/1910 Lark
980,131 A 12/1910 Shean
998,642 A 7/1911 Shean
1,075,914 A 10/1913 Hoes
1,094,143 A 4/1914 Hagstrom
1,142,463 A 6/1915 Shepherd
1,174,652 A 3/1916 Banks
1,247,052 A 11/1917 Wilson
1,251,467 A 1/1918 Blixt et al.
1,277,174 A 8/1918 Bakst
1,359,347 A 11/1920 Fleisher
1,366,909 A 2/1921 Frommer
1,368,141 A 2/1921 Hagstrom
1,529,085 A 3/1925 Preble
1,574,023 A 2/1926 Crompton et al.
1,596,992 A 8/1926 Ognowicz
1,646,674 A 10/1927 Angelillo
1,666,654 A 4/1928 Hiering
1,716,113 A 6/1929 Carlson
1,974,253 A 9/1934 Sandor
2,535,947 A 12/1950 Newell
2,729,089 A 1/1956 Pelcin
2,739,002 A 3/1956 Johnson
2,862,750 A 12/1958 Minke
2,887,336 A 5/1959 Meyer
2,905,493 A 9/1959 Tocchetto
3,064,462 A 11/1962 Ng et al.
3,083,560 A 4/1963 Scott
3,124,378 A 3/1964 Jackson
3,157,042 A 11/1964 Wolz
3,162,472 A 12/1964 Rust
3,214,947 A 11/1965 Wikkerink
3,250,100 A 5/1966 Cornaro
3,332,182 A 7/1967 Mark
3,378,290 A 4/1968 Sekulich
3,413,025 A 11/1968 Sperry
3,437,364 A 4/1969 Walters
RE26,677 E 10/1969 Russell et al.
3,498,657 A 3/1970 Giampiero
3,578,368 A 5/1971 Dupuis
3,586,360 A 6/1971 Perrotta
3,617,080 A 11/1971 Miller
3,670,537 A 6/1972 Horgan, Jr.
3,792,884 A 2/1974 Tutikawa
3,806,171 A 4/1974 Fernandez
3,899,201 A 8/1975 Paioletti
3,904,229 A 9/1975 Waldo
3,919,808 A 11/1975 Simmons
3,933,382 A 1/1976 Counts
3,940,886 A 3/1976 Ellingson, Jr.
3,953,061 A 4/1976 Hansen et al.
4,076,289 A 2/1978 Fellows et al.
4,116,479 A 9/1978 Poe
4,130,306 A 12/1978 Brkic
4,132,438 A 1/1979 Guymer
4,135,377 A 1/1979 Kleefeldt
4,146,994 A 4/1979 Williams
4,236,396 A 12/1980 Surko et al.
4,273,368 A 6/1981 Tanaka
4,283,882 A 8/1981 Hubbard
4,288,944 A 9/1981 Donovan
4,362,328 A 12/1982 Tacheny
4,365,490 A 12/1982 Manzoni
4,372,594 A 2/1983 Gater
4,476,700 A 10/1984 King
4,500,122 A 2/1985 Douglas
4,547,006 A 10/1985 Castanier
4,548,432 A 10/1985 Bengtsson
4,593,542 A 6/1986 Rotondi et al.
4,595,220 A 6/1986 Hatchett, Jr.
4,602,490 A 7/1986 Glass
4,602,812 A 7/1986 Bourner
4,607,510 A 8/1986 Shanaan et al.
4,633,688 A 1/1987 Beudat
4,639,025 A 1/1987 Fann
4,643,005 A 2/1987 Logas
4,691,543 A 9/1987 Watts
4,704,880 A 11/1987 Schlindwein
4,706,512 A 11/1987 McKernon et al.
4,717,909 A 1/1988 Davis
4,754,624 A 7/1988 Fleming et al.
4,768,817 A 9/1988 Fann
4,799,719 A 1/1989 Wood
4,893,849 A 1/1990 Schlack
4,913,475 A 4/1990 Bushnell et al.
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,114,192 A 5/1992 Toledo
5,118,151 A 6/1992 Nicholas, Jr. et al.
5,125,703 A 6/1992 Clancy et al.
5,148,691 A 9/1992 Wallden
5,171,050 A 12/1992 Mascotte
5,172,944 A 12/1992 Munich et al.
5,184,852 A 2/1993 O'Brien
5,193,861 A 3/1993 Juga
5,197,771 A 3/1993 Kaup et al.
5,257,841 A 11/1993 Geringer
5,265,452 A 11/1993 Dawson et al.
5,290,077 A 3/1994 Fleming
5,364,138 A 11/1994 Dietrich
5,373,716 A 12/1994 MacNeil et al.
5,382,060 A 1/1995 O'Toole et al.
5,388,875 A 2/1995 Fleming
5,394,718 A 3/1995 Hotzi
5,404,737 A 4/1995 Hotzl
5,441,315 A 8/1995 Kleefeldt
5,456,503 A 10/1995 Russell et al.
5,482,334 A 1/1996 Hotzl
5,495,731 A 3/1996 Riznik
5,496,082 A 3/1996 Zuckerman
5,498,038 A 3/1996 Simon
5,513,505 A 5/1996 Danes
5,516,160 A 5/1996 Kajuch
5,524,941 A 6/1996 Fleming
5,524,942 A 6/1996 Fleming
5,531,086 A 7/1996 Bryant
5,544,924 A 8/1996 Paster
5,546,777 A * 8/1996 Liu ..... E05C 1/06 292/DIG. 60
5,603,534 A 2/1997 Fuller
5,609,372 A 3/1997 Ponelle
5,620,216 A 4/1997 Fuller
5,628,216 A * 5/1997 Qureshi ..... E05B 15/04 292/201
5,707,090 A 1/1998 Sedley
5,716,154 A 2/1998 Miller et al.
5,722,704 A 3/1998 Chaput et al.
5,728,108 A 3/1998 Griffiths et al.
5,735,559 A 4/1998 Frolov
5,757,269 A 5/1998 Roth
5,782,114 A 7/1998 Zeus et al.
5,791,179 A 8/1998 Brask
5,791,700 A 8/1998 Biro
5,820,170 A 10/1998 Clancy
5,820,173 A 10/1998 Fuller
5,825,288 A 10/1998 Wojdan
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.

(56) References Cited

U.S. PATENT DOCUMENTS 5,911,460 A * 6/1999 Hawkins ..... E05B 63/248 292/144
5,911,763 A 6/1999 Quesada
5,915,764 A 6/1999 MacDonald
5,918,916 A 7/1999 Kajuch
5,931,430 A 8/1999 Palmer
5,946,956 A 9/1999 Hotzl
5,951,068 A 9/1999 Strong et al.
5,979,199 A 11/1999 Elpern
6,050,115 A 4/2000 Schroter et al.
6,079,585 A 6/2000 Lentini
6,089,058 A 7/2000 Elpern
6,094,869 A 8/2000 Magoon et al.
6,094,952 A * 8/2000 Clark ..... E05B 17/2092 70/333 R
6,098,433 A 8/2000 Manaici
6,112,563 A 9/2000 Ramos
6,116,067 A 9/2000 Myers
6,119,538 A 9/2000 Chang
6,120,071 A 9/2000 Picard
D433,916 S 11/2000 Frey
6,145,353 A 11/2000 Doucet
6,147,622 A 11/2000 Fonea
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 11/2001 Kang
6,327,881 B1 12/2001 Grundler et al.
6,389,855 B2 5/2002 Renz et al.
6,441,735 B1 8/2002 Marko
6,443,506 B1 9/2002 Su
6,453,616 B1 9/2002 Wright
6,454,322 B1 9/2002 Su
6,457,751 B1 10/2002 Hartman
6,490,895 B1 12/2002 Weinerman
6,502,435 B2 1/2003 Watts et al.
6,516,641 B1 2/2003 Segawa
6,517,127 B1 2/2003 Lu et al.
6,540,268 B2 4/2003 Pauser
6,564,596 B2 5/2003 Huang
6,568,726 B1 5/2003 Caspi
6,580,355 B1 6/2003 Milo
6,619,085 B1 9/2003 Hsieh
6,637,784 B1 10/2003 Hauber
6,672,632 B1 1/2004 Speed et al.
6,688,656 B1 2/2004 Becken
6,725,693 B2 4/2004 Yu et al.
6,733,051 B1 5/2004 Cowper
6,776,441 B2 8/2004 Liu
6,810,699 B2 11/2004 Nagy
6,813,916 B2 11/2004 Chang
6,871,451 B2 3/2005 Harger et al.
6,905,152 B1 6/2005 Hudson
6,929,293 B2 8/2005 Tonges
6,935,662 B1 8/2005 Hauber et al.
6,945,572 B1 9/2005 Hauber
6,962,377 B2 11/2005 Tonges
6,971,686 B2 12/2005 Becken
6,994,383 B2 2/2006 Morris
7,000,959 B2 2/2006 Sanders
7,010,945 B2 3/2006 Yu
7,010,947 B2 3/2006 Milo
7,025,394 B1 4/2006 Hunt
7,032,418 B2 4/2006 Martin
7,052,054 B2 5/2006 Luker
7,083,206 B1 8/2006 Johnson
7,128,350 B2 10/2006 Eckerdt
7,152,441 B2 12/2006 Friar
7,155,946 B2 1/2007 Lee et al.
7,203,445 B2 4/2007 Uchida
7,207,199 B2 4/2007 Smith et al.
7,249,791 B2 7/2007 Johnson
7,261,330 B1 8/2007 Hauber
7,353,637 B2 4/2008 Harger et al.
7,404,306 B2 7/2008 Walls et al.
7,410,194 B2 8/2008 Chen
7,418,845 B2 9/2008 Timothy
7,513,540 B2 4/2009 Hagemeyer et al.
7,526,933 B2 5/2009 Meekma
7,634,928 B2 12/2009 Hunt
7,637,540 B2 12/2009 Chiang
7,677,067 B2 3/2010 Riznik et al.
7,686,207 B1 3/2010 Jeffs
7,707,862 B2 5/2010 Walls et al.
7,726,705 B2 6/2010 Kim
7,735,882 B2 6/2010 Abdollahzadeh et al.
7,748,759 B2 7/2010 Chen
7,856,856 B2 12/2010 Shvartz
7,878,034 B2 2/2011 Alber et al.
7,946,080 B2 5/2011 Ellerton
7,963,573 B2 6/2011 Blomqvist
8,079,240 B2 12/2011 Brown et al.
8,161,780 B1 4/2012 Huml
8,182,002 B2 5/2012 Fleming
8,325,039 B2 12/2012 Picard
8,348,308 B2 1/2013 Hagemeyer et al.
8,376,414 B2 2/2013 Nakanishi et al.
8,376,415 B2 2/2013 Uyeda
8,382,166 B2 2/2013 Hagemeyer et al.
8,382,168 B2 2/2013 Carabalona
8,398,126 B2 3/2013 Nakanishi et al.
8,403,376 B2 3/2013 Greiner
8,494,680 B2 7/2013 Sparenberg et al.
8,550,506 B2 10/2013 Nakanishi
8,567,631 B2 10/2013 Brunner
8,628,126 B2 1/2014 Hagemeyer et al.
8,646,816 B2 2/2014 Dziurdzia
8,839,562 B2 9/2014 Madrid
8,840,153 B2 9/2014 Juha
8,850,744 B2 10/2014 Bauman et al.
8,851,532 B2 10/2014 Gerninger
8,876,172 B2 11/2014 Denison
8,899,635 B2 12/2014 Nakanishi
8,922,370 B2 12/2014 Picard
8,939,474 B2 1/2015 Hagemeyer et al.
9,428,937 B2 8/2016 Tagtow et al.
9,482,035 B2 11/2016 Wolf
9,512,654 B2 12/2016 Armari et al.
9,605,444 B2 3/2017 Rickenbaugh
9,637,957 B2 5/2017 Hagemeyer et al.
9,758,997 B2 9/2017 Hagemeyer et al.
9,765,550 B2 9/2017 Hemmingsen et al.
9,790,716 B2 10/2017 Hagemeyer et al.
9,822,552 B2 11/2017 Eller et al.
10,087,656 B1 10/2018 Cannella
10,174,522 B2 1/2019 Denison
10,240,366 B2 3/2019 Sotes Delgado
10,246,914 B2 4/2019 Sieglaar
10,273,718 B2 4/2019 Cannella
10,400,477 B2 9/2019 Moon
10,487,544 B2 11/2019 Ainley
10,662,675 B2 * 5/2020 Tagtow ..... E05B 9/002
10,738,506 B2 8/2020 Holmes
10,808,424 B2 * 10/2020 Criddle ..... E05B 47/02
10,822,836 B2 11/2020 Nakasone
10,968,661 B2 * 4/2021 Tagtow ..... E05B 47/0012
11,021,892 B2 * 6/2021 Tagtow ..... E05B 47/026
11,441,333 B2 * 9/2022 Tagtow ..... E05B 47/0012
2002/0104339 A1 8/2002 Saner
2003/0024288 A1 2/2003 Gokcebay et al.
2003/0159478 A1 8/2003 Nagy
2004/0003633 A1 1/2004 Alexander
2004/0004360 A1 1/2004 Huang
2004/0011094 A1 1/2004 Hsieh
2004/0066046 A1 4/2004 Becken

(56) References Cited

U.S. PATENT DOCUMENTS

2004/0089037 A1 5/2004 Chang
2004/0107746 A1 6/2004 Chang
2004/0107747 A1 6/2004 Chang
2004/0112100 A1 6/2004 Martin
2004/0145189 A1 7/2004 Liu
2004/0227349 A1 11/2004 Denys
2004/0239121 A1 12/2004 Morris
2005/0029345 A1 2/2005 Waterhouse
2005/0044908 A1 3/2005 Min
2005/0050928 A1 3/2005 Frolov
2005/0103066 A1 5/2005 Botha et al.
2005/0144848 A1 7/2005 Harger et al.
2005/0166647 A1 8/2005 Walls
2005/0180562 A1 8/2005 Chiang
2005/0229657 A1 10/2005 Johansson et al.
2006/0043742 A1 3/2006 Huang
2006/0071478 A1 4/2006 Denys
2006/0076783 A1 4/2006 Tsai
2006/0150516 A1 7/2006 Hagemeyer
2006/0208509 A1 9/2006 Bodily
2007/0068205 A1 3/2007 Timothy
2007/0080541 A1 4/2007 Fleming
2007/0113603 A1 5/2007 Polster
2007/0170725 A1 7/2007 Speyer et al.
2007/0259551 A1 11/2007 Rebel
2008/0000276 A1 1/2008 Huang
2008/0001413 A1 1/2008 Lake
2008/0087052 A1 4/2008 Abdollahzadeh et al.
2008/0092606 A1 4/2008 Meekma
2008/0093110 A1 4/2008 Bagung
2008/0141740 A1 6/2008 Shvartz
2008/0150300 A1 6/2008 Harger et al.
2008/0156048 A1 7/2008 Topfer
2008/0156049 A1 7/2008 Topfer
2008/0157544 A1 7/2008 Phipps
2008/0178530 A1 7/2008 Ellerton et al.
2008/0179893 A1 7/2008 Johnson
2008/0184749 A1 8/2008 Alber et al.
2008/0191499 A1 8/2008 Stein
2009/0064737 A1 3/2009 Fan
2009/0078011 A1 3/2009 Avni
2009/0218832 A1 9/2009 Mackle
2009/0314042 A1 12/2009 Fan
2009/0315669 A1 12/2009 Lang
2010/0107707 A1 5/2010 Viviano
2010/0154490 A1 6/2010 Hagemeyer et al.
2010/0213724 A1 8/2010 Uyeda
2010/0236302 A1 9/2010 Uyeda
2010/0313612 A1 12/2010 Eichenstein
2010/0327610 A1 12/2010 Nakanishi et al.
2011/0056254 A1 3/2011 Tsai
2011/0198867 A1 8/2011 Hagemeyer et al.
2011/0289987 A1 12/2011 Chiou et al.
2011/0314877 A1 12/2011 Fang
2012/0001443 A1 1/2012 Mitchell
2012/0146346 A1 6/2012 Hagemeyer et al.
2012/0235428 A1 9/2012 Blacklaws et al.
2012/0306220 A1 12/2012 Hagemeyer et al.
2013/0019643 A1 1/2013 Tagtow et al.
2013/0081251 A1 4/2013 Hultberg
2013/0140833 A1 6/2013 Hagemeyer et al.
2013/0152647 A1 6/2013 Terei et al.
2013/0167671 A1* 7/2013 Huang ..... E05B 47/068 74/25
2013/0176107 A1 7/2013 Dumas et al.
2013/0200636 A1 8/2013 Hagemeyer et al.
2013/0234449 A1 9/2013 Dery et al.
2013/0276488 A1 10/2013 Haber
2014/0060127 A1 3/2014 Hemmingsen et al.
2014/0125068 A1 5/2014 Hagemeyer et al.
2014/0159387 A1 6/2014 Hagemeyer et al.
2014/0182343 A1 7/2014 Talpe
2014/0367978 A1 12/2014 Geringer
2015/0075233 A1 3/2015 Pluta
2015/0089804 A1 4/2015 Picard
2015/0114176 A1 4/2015 Bisang
2015/0170449 A1 6/2015 Chandler, Jr.
2015/0176311 A1 6/2015 Picard
2015/0252595 A1 9/2015 Hagemeyer et al.
2016/0083976 A1 3/2016 Rickenbaugh
2016/0094103 A1* 3/2016 Lien ..... E05B 17/002 292/336.3
2016/0108650 A1 4/2016 Hagemeyer et al.
2016/0369525 A1 12/2016 Tagtow et al.
2018/0023320 A1 1/2018 McKibben
2018/0051478 A1 2/2018 Tagtow
2018/0051480 A1 2/2018 Tagtow
2018/0119462 A1 5/2018 Hagemeyer
2018/0155962 A1 6/2018 Mitchell et al.
2018/0298642 A1 10/2018 Tagtow
2018/0313116 A1 11/2018 Criddle
2019/0024437 A1 1/2019 Tagtow
2019/0032368 A1 1/2019 Welbig et al.
2019/0277062 A1 9/2019 Tagtow
2020/0149327 A1* 5/2020 Lammers ..... E05B 17/0029
2020/0354990 A1 11/2020 Tagtow
2020/0370338 A1 11/2020 Holmes

FOREIGN PATENT DOCUMENTS

CN 1243908 2/2000
CN 2554288 Y 6/2003
CN 2595957 Y 12/2003
CN 2660061 12/2004
CN 201031548 Y 3/2008
CN 202047652 U 11/2011
CN 108193950 A * 6/2018 ..... E05B 47/0012
DE 1002656 12/1957
DE 1584112 9/1969
DE 2639065 3/1977
DE 3032086 3/1982
DE 3836693 5/1990
DE 9011216 10/1990
DE 4224909 2/1993
DE 29807860 8/1998
DE 20115378 U1 11/2001
DE 10253240 5/2004
DE 202012002743 U1 4/2012
DE 202013000920 U1 4/2013
DE 202013000921 U1 4/2013
DE 202013001328 U1 5/2013
EP 0007397 A1 2/1980
EP 0231042 A2 8/1987
EP 0268750 6/1988
EP 341173 11/1989
EP 359284 3/1990
EP 661409 7/1995
EP 792987 9/1997
EP 1106761 6/2001
EP 1283318 2/2003
EP 1449994 8/2004
EP 1574642 9/2005
EP 1867817 12/2007
EP 2128362 12/2009
EP 2273046 A2 1/2011
EP 2339099 A1 6/2011
EP 2450509 5/2012
EP 2581531 A1 4/2013
EP 2584123 A1 4/2013
EP 2584124 A2 4/2013
EP 2998483 3/2016
EP 3091152 A1 11/2016
FR 363424 7/1906
FR 370890 2/1907
FR 21883 4/1921
FR 1142316 3/1957
FR 1162406 A 9/1958
FR 1201087 12/1959
FR 2339723 9/1977
FR 2342390 9/1977
FR 2344695 10/1977
FR 2502673 10/1982
FR 2848593 2/2005
FR 3017641 8/2015

(56) References Cited

FOREIGN PATENT DOCUMENTS

| | | | |
|---|---|---|---|
| GB | 226170 | | 4/1925 |
| GB | 264373 | A | 1/1927 |
| GB | 583655 | | 12/1946 |
| GB | 612094 | A | 11/1948 |
| GB | 179849 | | 1/1978 |
| GB | 1498849 | | 1/1978 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| JP | 64-083777 | | 3/1989 |
| JP | 2003343141 | | 12/2003 |
| JP | 2006112042 | | 4/2006 |
| JP | 2008002203 | | 1/2008 |
| KR | 2011094706 | | 8/2011 |
| NL | 8105627 | | 7/1983 |
| SE | 309372 | | 3/1969 |
| WO | 96/25576 | | 8/1996 |
| WO | 97/41323 | | 11/1997 |
| WO | 02/33202 | | 4/2002 |
| WO | 2007/104499 | | 9/2007 |
| WO | 2009/059112 | | 5/2009 |
| WO | 2010071886 | | 6/2010 |
| WO | 2015/079290 | | 6/2015 |
| WO | 2020/023652 | | 1/2020 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"UPVC Window Hardware and uPVC Door Hardware online", http://www.upvc-hardware.co.uk/, accessed Oct. 27, 2011, original publication date unknown, 2 pgs.

Doorking.com—Electric Locks—Strikes and Deadbolts; printed from https://www.doorking.com/access-control/electricocks-strikes-deadbolts, 2 pages, Feb. 2016.

Magneticlocks.net—Electric Strikes and Deadbolts; printed from https://www.magneticlocks.net/electric-strikes-and-deadbolts/electric-strikes.html, 8 pages, Feb. 2016.

sdcsecurity.com—Latch and Deadbolt Monitoring Strikes; printed from http://www.sdcsecurity.com/monitor-strike-kits2.htm, 2 pages, Feb. 2016.

Lovejoy product catalog cutout, obtained on Oct. 4, 2018, "Jaw", 1 page.

* cited by examiner

FLEXIBLE COUPLING FOR ELECTRONIC DEADBOLT SYSTEMS

CROSS-REFERENCE TO RELATED APPLICATIONS

This application claims priority to and the benefit of U.S. Provisional Patent Application No. 62/756,356, filed Nov. 6, 2018, the disclosure of which is hereby incorporated by reference herein in its entirety.

INTRODUCTION

Deadbolts are typically operated by a user (e.g., with a key on an outside of the door or a thumbturn on the inside of the door) to secure a door or a window against unwanted intrusions. At least some known deadbolts are motorized, but it can often be difficult to install these systems within doors, as well as deliver reliable power. Additionally, during operation of at least some motorized deadbolts, the drive systems may undesirably experience increased loading at the end of the stroke length of the deadbolt.

SUMMARY

In an aspect, the technology relates to an electronic deadbolt including: a housing; a deadbolt configured to extend or retract from the housing; and a drive system disposed at least partially within the housing, wherein the drive system includes: an electric motor; a leadscrew coupled between the electric motor and the deadbolt, wherein the leadscrew is rotatable about a longitudinal axis so as to dive movement of the deadbolt; and a flexible coupling disposed between the electric motor and the leadscrew.

In an example, the flexible coupling includes: a drive hub including at least one drive lug; a driven hub including at least one driven lug; and a flexible collar disposed at least partially between the at least one drive lug and the at least one driven lug. In another example, the at least one drive lug and the at least one driven lug extend radially relative to the longitudinal axis. In still another example, the leadscrew has a first end and an opposite second end, and the first end is threadingly coupled to the deadbolt and the second end includes the driven hub. In yet another example, the driven hub is integral with the second end of the leadscrew. In an example, the driven hub includes a bore sized and shaped to at least partially receive the drive hub and the flexible collar.

In another example, the drive hub includes a pair of drive lugs of the at least one drive lug spaced approximately 180° apart and the driven hub includes a pair of driven lugs of the at least one driven lug spaced approximately 180° apart. In still another example, the flexible collar includes four legs, each disposed between a drive lug of the pair of drive lugs and a driven lug of the pair of driven lugs. In yet another example, the housing defines the longitudinal axis. In an example, the flexible coupling is configured to absorb torsional loads generated by the movement of the deadbolt.

In another aspect, the technology relates to a drive system for an electronic lock device including a locking element and a housing, wherein the drive system includes: an electric motor; a rotatable shaft coupled to the electric motor and rotatable about a longitudinal axis; a drive hub coupled to the rotatable shaft; a driven hub rotationally engaged with the drive hub; a leadscrew coupled to the driven hub, wherein upon rotation of the leadscrew the locking element extends or retracts from the housing; and a flexible collar disposed at least partially between the drive hub and the driven hub, wherein the flexible collar is configured to absorb torsional loads between the drive hub and the driven hub.

In an example, the electric motor includes at least one gear. In another example, the drive hub is at least partially received within the driven hub. In still another example, the driven hub is integral with the leadscrew. In yet another example, the drive hub includes a plurality of drive lugs and the driven hub includes a plurality of driven lugs, the flexible collar includes a plurality of legs and each leg is disposed between one drive lug of the plurality of drive lugs and one driven lug of the plurality of driven lugs. In an example, each leg is in direct contact with the drive lug and the driven lug.

In another example, the plurality of legs are connected to one another. In still another example, the electric motor, the rotatable shaft, and the leadscrew are axially aligned along the longitudinal axis.

In another aspect, the technology relates to an electronic lock device for a door or a window including: a housing; a locking element; and a drive system disposed at least partially within the housing and configured to extend or retract the locking element from the housing, wherein the drive system includes: an electric motor including one or more gears driving a rotatable shaft about a longitudinal axis; a leadscrew coupled between the electric motor and the locking element, wherein the leadscrew is rotatable about the longitudinal axis so as to drive movement of the locking element; and a flexible coupling disposed between the electric motor and the leadscrew, wherein the flexible coupling includes: a drive hub including a pair of drive lugs coupled to the rotatable shaft; a driven hub including a pair of driven lugs coupled to the leadscrew; and a flexible collar disposed at least partially between the drive hub and the driven hub.

In an example, the flexible coupling is axially aligned with the leadscrew and the electric motor along the longitudinal axis.

BRIEF DESCRIPTION OF THE DRAWINGS

There are shown in the drawings, examples that are presently preferred, it being understood, however, that the technology is not limited to the precise arrangements and instrumentalities shown.

DETAILED DESCRIPTION

Figure 1:
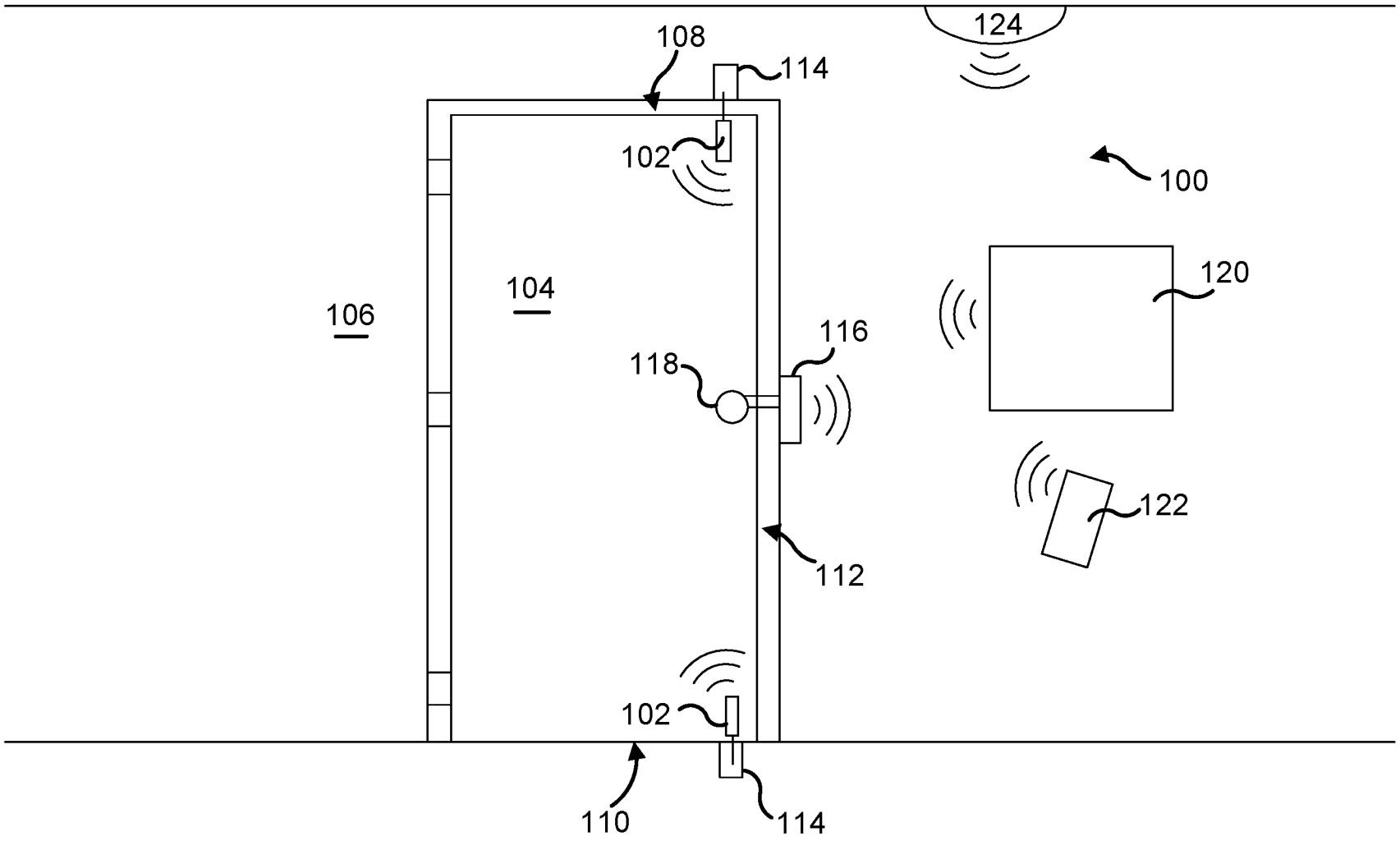
FIG. 1 depicts a schematic view of an electronic door lock system.

FIG. 1 depicts a schematic view of one example of a multi-point electric door lock system 100. The system 100 includes two electronic deadbolts 102 installed in a door panel 104, for example, so as to extend into a portion of a frame 106 such as a head and/or a sill thereof. In other examples, the electronic deadbolts 102 may be installed within a locking edge of the door panel 104 so as to extend into a vertical portion of the frame 106 between the head and the sill. Alternatively, the electronic deadbolts 102 may be installed in the frame 106 so as to extend into the door 104. Additionally, the placement and number of electronic deadbolts 102 may be altered as required or desired for a particular application, for example, in pivoting doors, the electronic deadbolts may be disposed so as to extend from a head 108, a sill 110, or a locking edge 112 (e.g., vertical edge) of the door 104.

In the example, the door panel 104 is a pivoting door; however, the electronic deadbolts described herein can be utilized in entry doors, sliding doors, pivoting patio doors, and any other door as required or desired. In sliding patio doors, the electronic deadbolts 102 have linearly extending locking elements that may extend from the head 108 or the sill 110 of the sliding door. If utilized on the locking edge 112 of a sliding door, the electronic deadbolt 102 would require a hook-shaped locking element that would hook about a keeper so as to prevent retraction of the door. Additionally or alternatively, the electronic deadbolts may be used in windows or any other panel type structure that can be locked with an extendable and/or retractable locking element.

In the example, each electronic deadbolt 102 is positioned to as to extend into a keeper 114. The keepers 114 may be standard keepers or electronic keepers as described in U.S. patent application Ser. No. 15/239,714, filed Aug. 17, 2016, entitled "Locking System Having an Electronic Keeper," and the disclosure of which is herein incorporated by reference in its entirety. The system 100 also includes an electronic keeper 116 configured to receive a standard (e.g., manually-actuated) deadbolt 118, as typically available on an entry or patio door.

In one example, once the deadbolt 118 is manually actuated into the locking position, the electronic keeper 116 detects a position of the deadbolt 118 therein. A signal may be sent to the remotely located electronic deadbolts 102, thus causing actuation thereof. At this point, the door 104 is now locked at multiple points. Unlocking of the manual deadbolt 118 is detected by the electronic keeper 116 (that is, the keeper 116 no longer detects the presence of the deadbolt 118 therein) and a signal is sent to the remote electronic deadbolts 102 causing retraction thereof, thus allowing the door 104 to be opened. Thus, the electronic deadbolts described herein may be utilized to create a robust multi-point locking system for a door and to improve the security thereof.

In another example, the system 100 may include a controller/monitoring system, which may be a remote panel 120, which may be used to extend or retract the electronic deadbolts 102, or which may be used for communication between the various electronic keepers 114 and deadbolts 102. Alternatively or additionally, an application on a remote computer or smartphone 122 may take the place of, or supplement, the remote panel 120. By utilizing a remote panel 120 and/or a smartphone 122, the electronic deadbolts 102 may be locked or unlocked remotely, thus providing multi-point locking ability without the requirement for manual actuation of the deadbolt 118. Additionally, any or all of the components (electronic deadbolt 102, keeper 116, panel 120, and smartphone 122) may communicate either directly or indirectly with a home monitoring or security system 124. The communication between components may be wireless, as depicted, or may be via wired systems.

Figure 2:
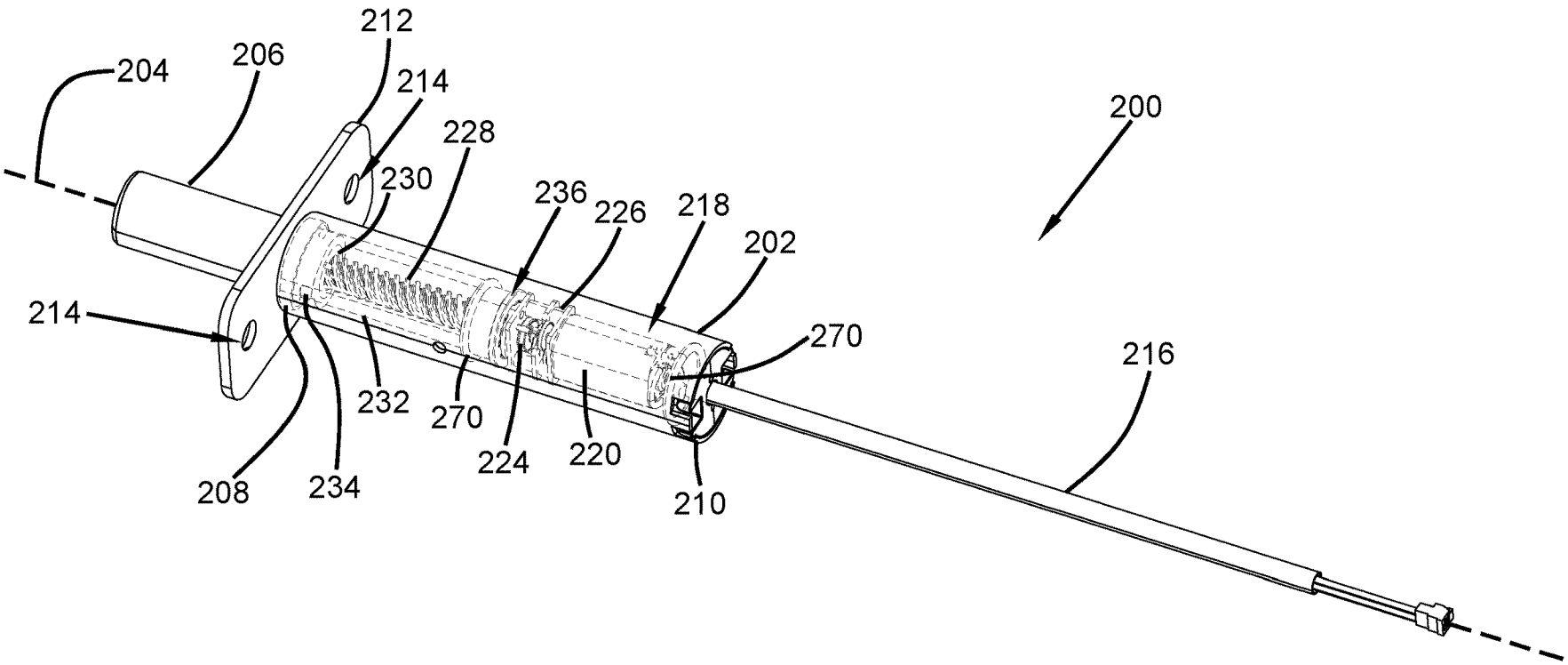
FIG. 2 is a perspective view of an exemplary electronic lock device.

FIG. 2 is a perspective view of an exemplary electronic lock device 200 that can be used with the multi-point electric door lock system 100 (shown in FIG. 1). The electronic lock device 200 is configured to be mounted on a door or door frame and provide a lock thereto. The electronic lock device 200 includes a housing 202 defining a longitudinal axis 204, and a locking element 206 configured to be extended and retracted from the housing 202. As illustrated in FIG. 2, the housing 202 is illustrated as transparent so as to show the components contained therein (e.g., depicted in dashed lines). In the example, the electronic lock device has a locking element that is a deadbolt 206 so that the device can be considered an electronic deadbolt 200. It is appreciated that while a deadbolt locking device is shown and described herein, the locking element can be of any other type, for example, a rhino hook, a shoot bolt, etc. as required or desired.

In the example, the deadbolt 206 is linearly moveable in relation to the housing 202 along the longitudinal axis 204. The housing 202 includes a first end 208 and an opposite second end 210 extending along the longitudinal axis 204. The deadbolt 206 is disposed at the first end 208 so that it may extend and retract along the longitudinal axis 204. A mounting plate 212 with apertures 214 may be coupled to the first end 208 to facilitate mounting the electronic deadbolt 200 to the door or door frame by one or more fasteners (not shown). Extending from the second end 210, an electrical connecting cable 216 is used to provide power and/or operational communication to the electronic deadbolt 200. In one example, the cable 216 may be coupled to a battery module (not shown) that is also mounted within the door and/or door frame. The battery module may couple to one or more lock devices 200 itself. In another example, the electrical cable 216 may be coupled to line power of the structure that the door and/or door frame is within. The housing 202 encloses a deadbolt drive system 218 that is disposed between the first end 208 and the second end 210 and coupled to the cable 216. As illustrated, the deadbolt 206 is a linearly extending locking member. In other examples, the deadbolt 206 may include hook-shaped locking members that rotate out of the housing 202 and enable sliding doors to be locked from the locking edge of the door.

The drive system 218 is disposed at least partially within the housing 202 and is configured to extend and retract the deadbolt 206 from the housing 202. The drive system 218 includes an electric motor 220 that is configured to rotatably drive a rotatable shaft 222 (shown in FIG. 4). The rotatable shaft 222 extends along the longitudinal axis 204 and rotates about the axis 204. The motor 220 may be an off-the-shelf DC unit that includes an integral gear set 224 surrounded by a chassis 226 and powered via the cable 216. The rotatable shaft of the motor 220 is coupled to a leadscrew 228 such that upon operation of the motor 220, the leadscrew 228 rotates about the longitudinal axis 204. The leadscrew 228 extends along the longitudinal axis 204 and is coupled to the deadbolt 206. In the example, the deadbolt 206 includes a nut 230 that threadably engages with the leadscrew 228, such that rotation of the leadscrew 228 translates into linear movement of the nut 230, and thereby, the deadbolt 206 along the longitudinal axis 204.

In the example, the deadbolt 206 or the nut 230 engages with one or more fixed guide channels 232 defined within the housing 202 and extending along the longitudinal axis 204 adjacent to the leadscrew 228. For example, the deadbolt 206 can have one or more projections 234 that are slidably received at least partially within a corresponding guide channel 232. The engagement between the projections 234 and the guide channels 232 prevent rotation of the nut 230, but allow longitudinal movement, so that upon rotation of the leadscrew 228, the deadbolt 206 can extend and retract from the housing 202. In one example, the electronic deadbolt 200 may be a portion of the electronic deadbolt systems that are described in U.S. patent application Ser. No. 15/954,940, filed Apr. 17, 2018, entitled "Modular Electronic Deadbolt Systems," and the disclosure of which is herein incorporated by reference in its entirety.

The longitudinal length of the guide channels 232 within the housing 202 may define the extension distance of the deadbolt 206 from the housing 202. As such, the ends of the guide channels 232 form a hard stop for the deadbolt 206. In other examples, other components of the lock device 200 may define the hard stop for the deadbolt 206. For example, the first end 208 of the housing 202 may form a hard stop for the deadbolt 206. These hard stops define the stroke length of the deadbolt 206 (e.g., the extension/retraction length along the longitudinal axis 204). That is, when the motor 220 is extending the deadbolt 206 from the housing 202, the motor 220 rotates in a first direction until the hard stop proximate the first end 208 contacts the deadbolt 206, thus preventing any further extension therefrom. The motor 220, however, still operates and drives against the hard stop until the system stops the extension operation. Similarly, when the motor 220 is retracting the deadbolt 206 into the housing 202, the motor 220 rotates in an opposite second direction until the hard stop proximate the second end 210 contacts the deadbolt 206, preventing any further retraction therein. The shock loads that are introduced into the drive system 218 from the hard stops (e.g., the motor 220 driving the deadbolt 206 into the hard stop and the continued motor drive until the system stops the extension/retraction operation) can undesirably reduce the life cycle of the drive system 218. More specifically, undesirable wear is introduced into one or more components of the drive system 218 from the hard stops and motor drive. For example, the teeth of the gear set 224 may crack and/or break due to these loads.

Accordingly, to at least partially absorb the loads generated by the hard stops and the motor drive, a flexible coupling 236 may be disposed between the motor 220 and the leadscrew 228. The flexible coupling 236 is configured to absorb torsional loads generated by the movement of the deadbolt 206 and allows these loads to be absorbed before reaching the gear set 224 and the motor 220, thereby increasing the life span of the drive system 218. Additionally, unlike stroke limit switches or stepper motor type drives, when the deadbolt 206 is between the hard stops and becomes bound (e.g., unable to axially move relative to the housing 202), the flexible coupling 236 also absorbs these loads to reduce wear on the gear set 224 and the motor 220. In the example, the flexible coupling 236 is axially aligned with the leadscrew 228 and the motor 220 along the longitudinal axis 204.

Figure 3:
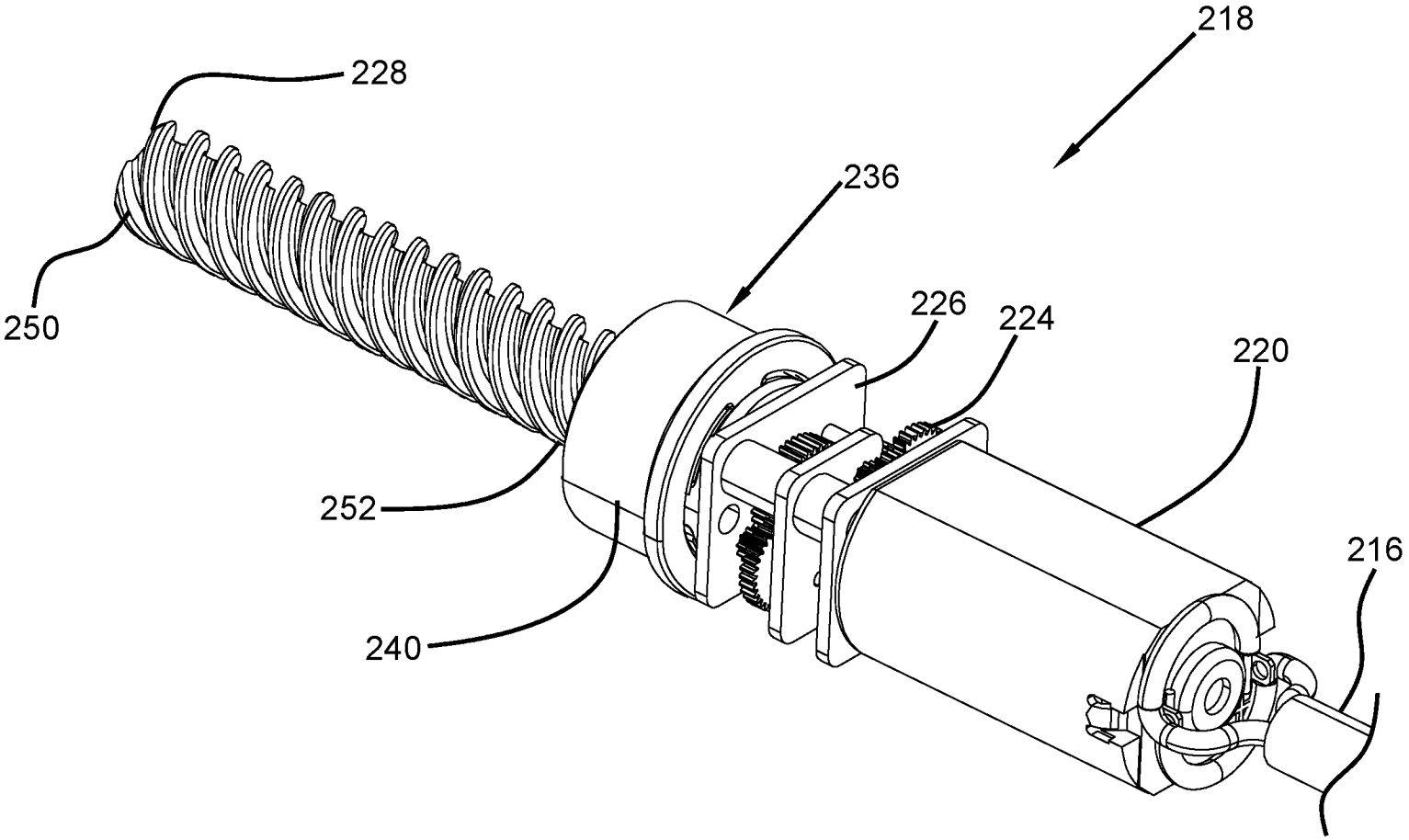
FIG. 3 is a perspective view of an exemplary drive system.
Figure 4:
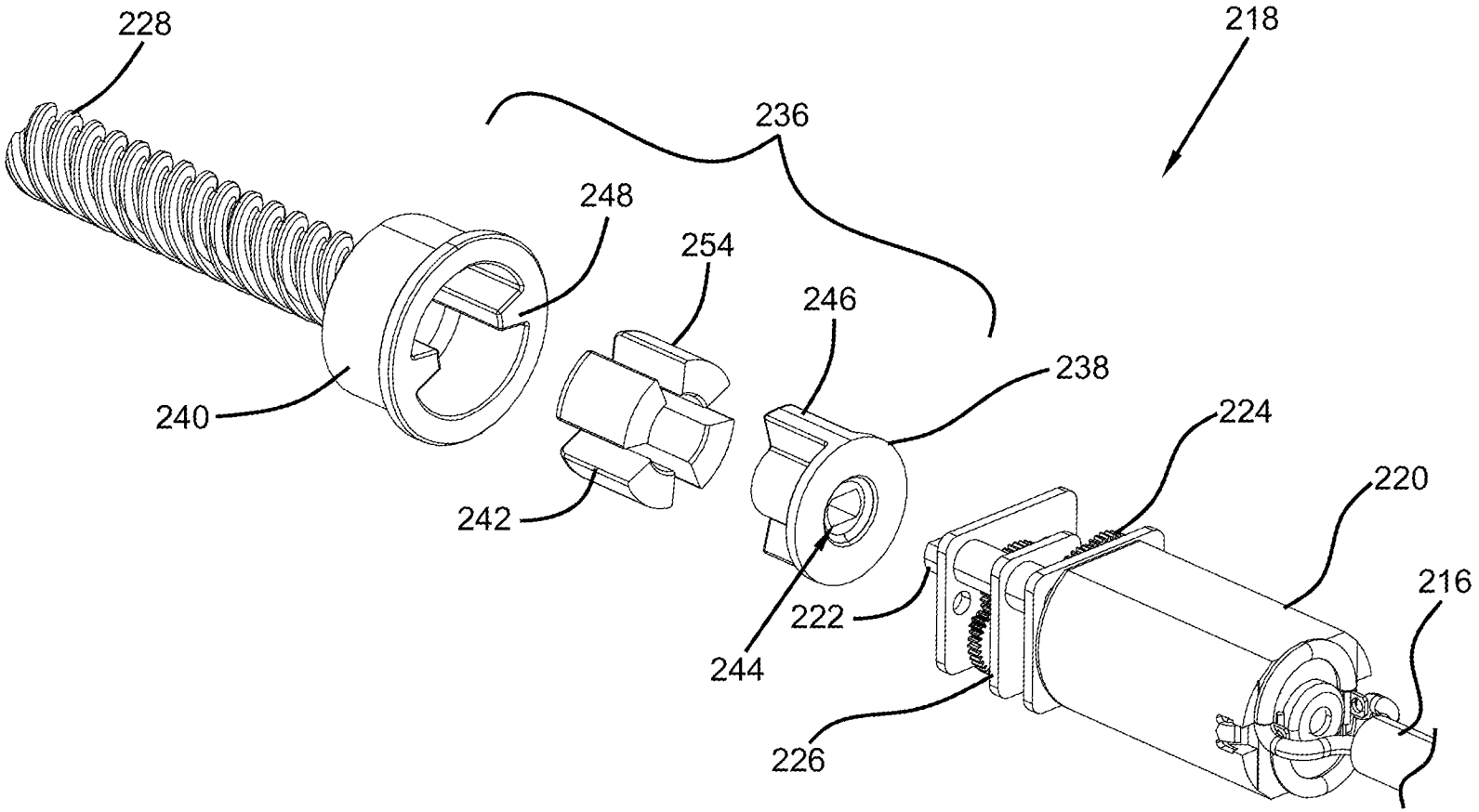
FIG. 4 is an exploded perspective view of the drive system shown in FIG. 3.

FIG. 3 is a perspective view of the drive system 218. FIG. 4 is an exploded perspective view of the drive system 218. Referring concurrently to FIGS. 3 and 4, the drive system 218 includes the electric motor 220 (e.g., a DC motor) connected to the cable 216. The motor 220 includes the gear set 224 surrounded by the chassis 226, and has the rotatable shaft 222 extending therefrom. In the example, the shaft 222 may have a double D shape, although other shapes are also contemplated herein. To couple the leadscrew 228 to the shaft 222, the flexible coupling 236 is used. The flexible coupling 236 is configured to absorb loads induced into the drive system 218 (e.g., by the hard stops of the deadbolt), thereby, increasing the life cycle of the motor 220 and gear set 224.

In the example, the flexible coupling 236 includes a drive hub 238 that is coupled to the shaft 222 so that the motor 220 can drive rotation of the hub 238. A driven hub 240 is coupled to the leadscrew 228 and is configured to rotationally engage with the drive hub 238. The flexible coupling 236 also includes a flexible collar 242 disposed at least partially between the drive hub 238 and the driven hub 240. The drive hub 238 includes an opening 244 that is sized and shaped to receive the shaft 222 so that the drive hub 238 is coupled to the shaft 222 via a slide on connection. The drive hub 238 also includes at least one drive lug 246 radially extending in an outward direction from the longitudinal axis 204 (shown in FIG. 2). In the example, the drive hub 238 includes two drive lugs that are spaced approximately 180° apart from one another.

The driven hub 240 includes at least one driven lug 248 radially extending in an inward direction from the longitudinal axis. In the example, the driven hub 240 includes two driven lugs that are spaced approximately 180° apart from one another. The leadscrew 228 has a first end 250 that is configured to threadingly couple to the deadbolt and an opposite second end 252 that couples to the driven hub 240. In one example, the driven hub 240 can be integral with the second end 252 of the leadscrew 228.

The drive hub 238 is configured to couple to the driven hub 240 so that upon rotation of the shaft 222, the drive lugs 246 engage with the driven lugs 248, and rotation of the shaft 222 is transferred to the leadscrew 228. In the example, the lug pairs 246, 248 do not completely fill the circumferential space around the longitudinal axis and as such, rotation of the drive hub 238 does not necessary induce direct rotation of the driven hub 240. That is, until the lugs 246, 248 are engaged with one another. In other examples, the number of lugs on each hub may be more (e.g., 3, 4, 5, etc.) or less (e.g., 1) as required or desired. In the example, the lugs 246, 248 on each hub are symmetrically spaced about the longitudinal axis. In other examples, the lugs 246, 248 on each hub may have different circumferential spacing such that the rotational distance until the lugs are engaged is different for forward rotation operation than for backward rotation operation.

In the example, the drive hub 238 is at least partially received within the driven hub 240. The driven hub 240 has an outer diameter that is greater than an outer diameter of the leadscrew 228. As such, the driven hub 240 is enlarged relative to the leadscrew. The enlarged driven hub 240 defines an open bore that is sized and shaped to at least partially receive the drive hub 238 and the flexible collar 242. By inserting the drive hub 238 within the driven hub 240 the axial length of the flexible coupling 236 is reduced so as to conserve space within the electronic lock device. In other examples, the drive hub 238 may be enlarged so as to receive the driven hub 240 therein.

The flexible collar 242 of the flexible coupling 236 is disposed at least partially between the drive lugs 246 and the driven lugs 248 and is configured to absorb torsional loads from transferring between the drive hub 238 and the driven hub 240. In the example, the flexible collar 242 includes four legs 254 that are each disposed between one drive lug 246 and one driven lug 248. This configuration enables for the drive hub 238 to be insertable within the driven hub 240 and reduces the axial length of the flexible coupling 236 within the drive system 218. In some examples, one or more of the four legs 254 may be connected to one another (e.g., along an inner circumferential surface, an outer circumferential surface, or an axial surface). In other examples, one or more of the four legs 254 may be discrete from one another.

In the example, each leg 254 of the flexible collar 242 circumferentially extends within the entire space between the drive lug 246 and the driven lug 248. That is, each leg 254 is in direct contact with both the adjacent drive lug 246 and the adjacent driven lug 248. As such, the flexible collar 242 is always engaged upon rotation of the hubs 238, 240 relative to one another. In other examples, the legs 254 are only partially disposed within the space between the drive lug 246 and the driven lug 248 so that the hubs 238, 240 may rotate relative to one another before the flexible collar 242 is engaged.

The flexible collar 242 may be a silicone-based material (e.g., a Shore A20 hardness), a neoprene-based material (e.g., a Shore A30 hardness), or any other material that enables to flexible coupling 236 to function as described herein. These materials enable the shock and torsion loads from the deadbolt travel to be absorbed, for example, through compression of the flexible collar 242, so that the loads do not travel from the leadscrew 228, through the drive system 218, and into the motor 220 and the gear set 224. Additionally, the materials are tear and impact resistant so that they can withstand a large number of extension and retraction cycles of the locking member.

Additionally, the flexible coupling 236 also reduces wear on the motor 220 and gear set 224 if the drive system 218 binds up during operation and between the hard stops that define the stroke length of the deadbolt. For example, if the deadbolt is extended against a strike plate so that the deadbolt cannot fully extend, the flexible coupling 236 reduces or prevents the resulting load from being transferred back to the motor 220 and gear set 224. In contrast, other systems, such as end of stroke limit switches or stepper motor type drives that can limit the hard stop loads, cannot do this, as it is only the hard stop areas that are load resistant.

Figure 5:
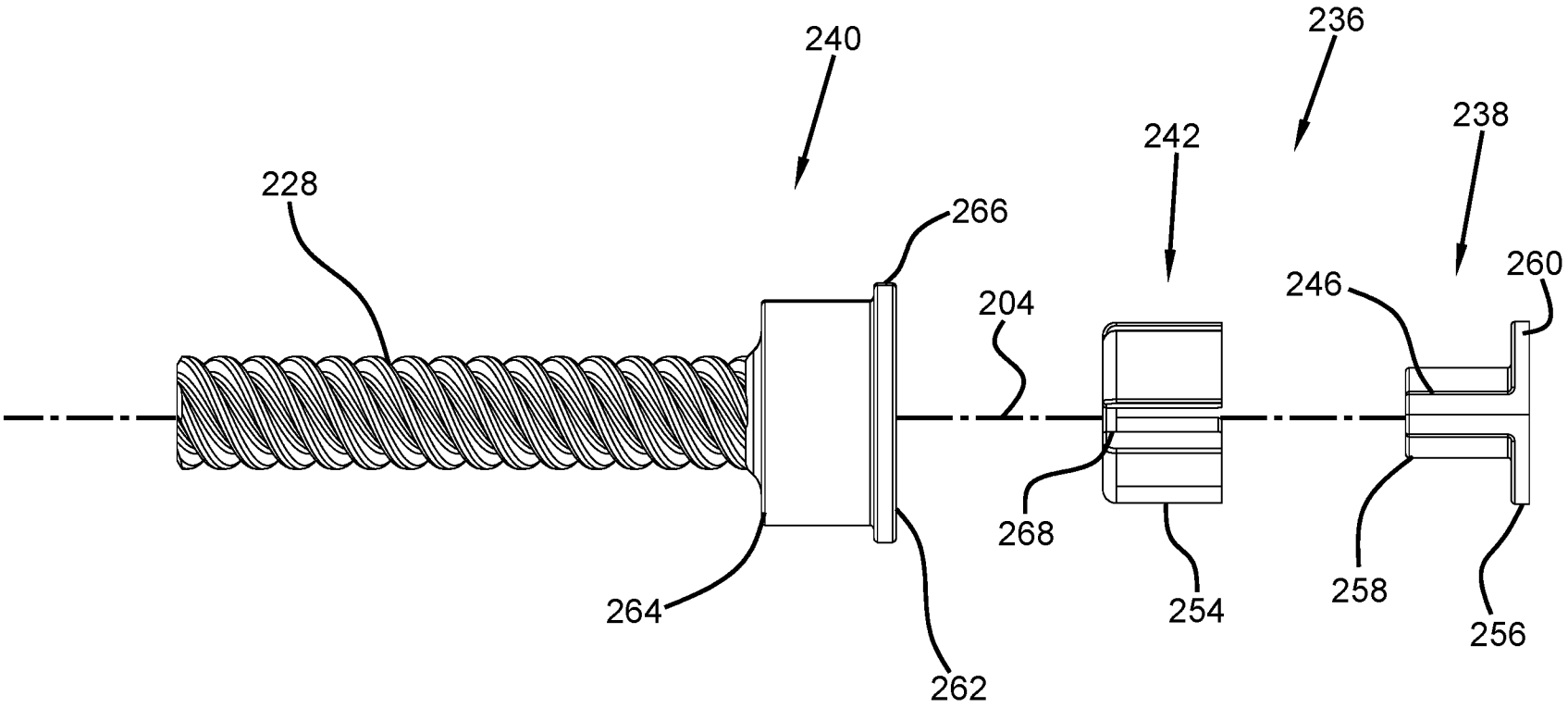
FIG. 5 is an exploded side view of an exemplary flexible coupling.

FIG. 5 is an exploded side view of the exemplary flexible coupling 236. In the example, the drive hub 238 has a first end 256 and an opposite second end 258 in an axial direction along the longitudinal axis 204. The first end 256 includes the opening 244 (shown in FIG. 5) that extends towards the second end 258 and so that the drive hub 238 can be coupled to the motor and rotatably driven thereby. The first end 256 also includes a radially extending flange 260 that extends outward from the opening 244. The flange 260 is positioned adjacent to the chassis 226 of the drive system 218 (both shown in FIG. 5) when assembled and provides support for the drive lugs 246. Additionally, the flange 260 provides an axial boundary for the flexible collar 242 so that the collar legs 254 are axially retained within the flexible coupling 236 and do not slide out of the flexible coupling when assembled. The drive lugs 246 extend from the second end 258 and towards the flange 260, and in a radially outward direction relative to the longitudinal axis 204.

The driven hub 240 also has a first end 262 and an opposite second end 264 in an axial direction. The driven hub 240 is substantially cylindrical in shape with an open bore at the first end 262 that is sized and shaped to receive the drive hub 238. The bore extends from the first end 262 in a direction towards the second end 264. The bore has an inner diameter that is greater than an outer diameter of the drive hub 238 so that the driven hub 240 can receive the drive hub 238 within. The first end 262 also includes a radially extending circumferential lip 266. The lip 266 is configured to be received within a corresponding circumferential channel with the housing 202 (shown in FIG. 2) so that the driven hub 240 is axially secured within the housing while still being enabled for rotational movement. The second end 264 of the driven hub 248 is enclosed so that the leadscrew 228 can extend therefrom. The driven lugs 248 (shown in FIG. 5) are positioned within the bore and extend from the first end 262 in a direction towards the second end 264 and in a radially inwardly direction.

The flexible collar 242 has legs 254 that extend in an axial direction and along the longitudinal axis 204. Each leg 254 is circumferentially spaced from one another so that the lugs 246, 248 can slide therebetween. In the example, one axial end of all of the legs 254 are coupled together by a connector 268. By connecting all of the legs 254 together, assembly of the flexible coupling 236 is more efficient. Additionally in the example, the connector 268 is positioned adjacent the second end 264 of the driven hub 240 when the flexible coupling 236 is assembled. As such, the connector 268 can be used to absorb axial loads between the two hubs 238, 240 so that the flexible coupling 236 can absorb both torsional and axial loads within the drive system. Opposite of the connector 268, the free ends of the legs 254 are positioned adjacent the flange 260 of the drive hub 238 when the flexible coupling 236 is assembled.

To accommodate the small size of many electronic deadbolts, the flexible coupling 236 has the drive hub 238 and the flexible collar 242 received entirely within the driven hub 240. This reduces the overall axial length of the flexible coupling 236 and can reduce the size of the electronic lock device. Additionally, the outer surface of the driven hub 240 can be used as a bearing surface within the housing so that the leadscrew 228 is supported within the housing. For example, with the lip 266. Additionally or alternatively, an O-ring 270 (shown in FIG. 2) may be located around the second end 264 of the driven hub 240 so as to form a seal within the housing and reduce dirt and debris from accumulating around the motor and/or gears. Another O-ring 270 may also be located at the second end of the housing as required or desired.

In other examples, the flexible coupling 236 may have the drive hub 238 and the driven hub 240 only axially aligned and one is not received within another. As such, the lugs 246, 248 can extend in an axial direction and the collar 242 is axially positioned between the hubs 238, 240. In this configuration, however, the axial length of the flexible coupling 236 is increased, compared to the example as illustrated in FIGS. 3-5.

Figure 6:
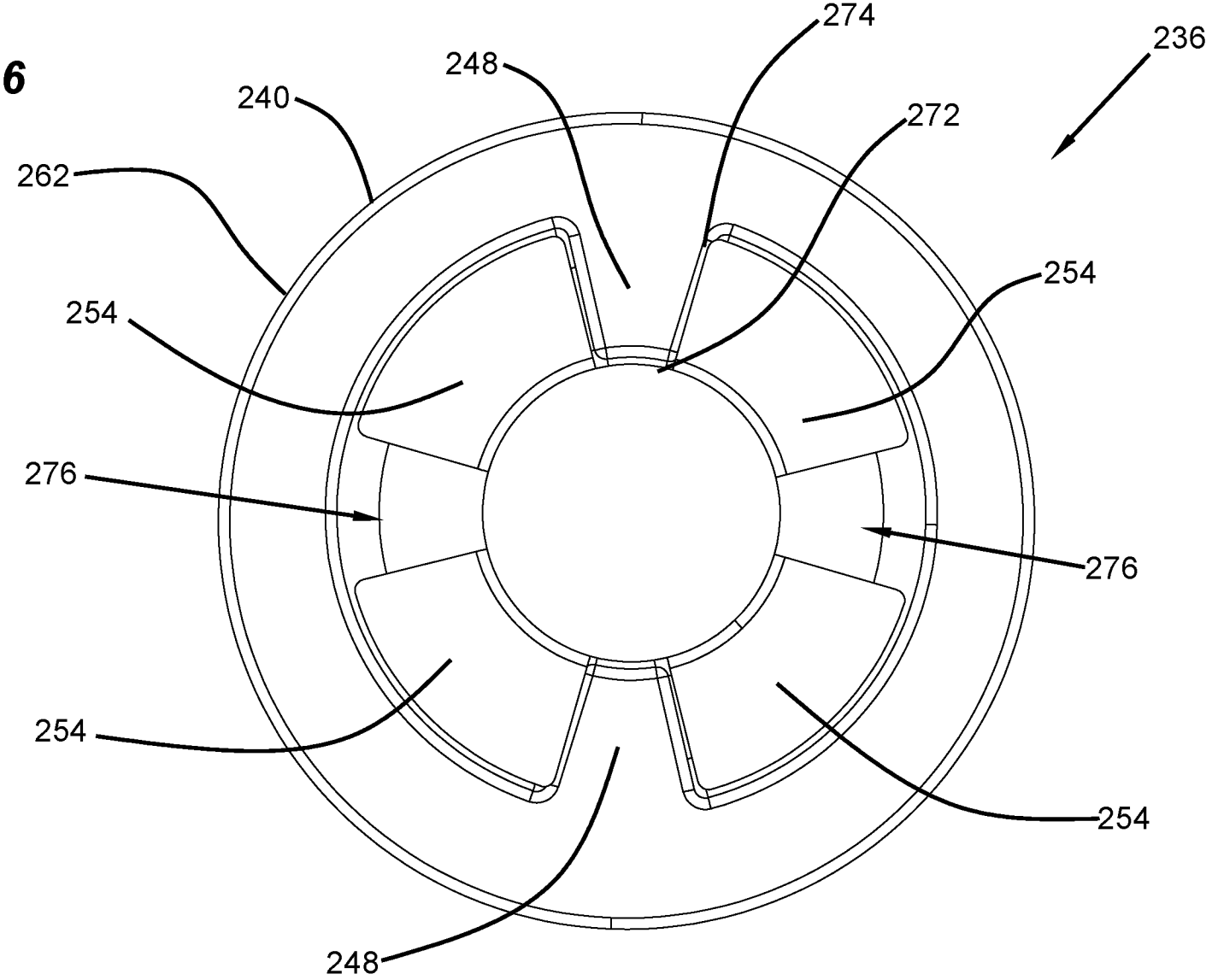
FIG. 6 is a partial end view of the flexible coupling shown in FIG. 5.

FIG. 6 is a partial end view of the flexible coupling 236. The drive hub 238 is not illustrated in FIG. 6 for clarity. Looking at the first end 262 of the driven hub 240, the driven lugs 248 are directly opposite one another and extend in an inward direction. In the example, the lugs 248 have a tip 272 that is smaller than a base 274 so that in cross-section, the lugs 248 are substantially tooth shaped. So that the flexible collar 242 can be circumferentially fit between the lugs 248, each leg 254 is spaced apart from another and this space 276 has a shape that corresponds to the shape of the lugs 248. As illustrated in FIG. 6, the void within the flexible collar 242 receives the drive hub 238. With the drive hub 238, the lugs 246 have a tip that is larger than a base so that the lugs can fit within the space 276 defined by the flexible collar 242. In an aspect, the size proportion between the lug tip and base is based on its radial position relative to the longitudinal axis. In other examples, the lugs can have any other shape that enables the flexible coupling 236 to function as described herein. For example, the lugs may be partially rounded or have a square or rectangle shape in cross-section.

When the flexible coupling 236 is assembled, each leg 254 of the flexible collar 242 is directly adjacent to the lugs. In one example, the compressive strength of the collar 242 may be such that any rotation of the drive hub 238 enables rotation of the driven hub 240. However, once a predetermined torque load is reached, the compressive strength of the collar 242 is overcome to absorb the excess loads and increase the life-cycle of the drive system. In another example, the compressive strength of the collar 242 may be such that the collar 242 can absorbs some rotational movement between the hubs. However, once the legs 254 are compressed to a predetermined value then rotational movement can be transferred between the hubs, and any further over-compression is used to absorb the excess loads. In either example, to define the absorption capacity of the collar 242, the compressive strength of the material can be specified as required or desired. For example, a lower compressive strength can allow more independent rotational movement between the hubs when compared to a higher compressive strength material. In some examples, the legs 254 may not be positioned directly against the lugs so that there is a gap between the leg and the lug to allow for more independent rotational movement between the hubs.

In the example, each leg 254 may circumferentially extend about 60° about the longitudinal axis. Additionally, each lug 246, 248 may circumferentially extend about 30° about the longitudinal axis. As such, the ratio between lugs and collar within the flexible coupling is about 1:2 and the legs are circumferentially larger than the lugs. In other examples, each leg 254 may circumferentially extend between about 20° and about 80°. In an aspect, each leg 254 may circumferentially extend between about 45° and about 75°. In yet another example, each lug 246, 248 may circumferentially extend between about 10° and 70°. In an aspect, each lug 246, 248 may circumferentially extend between about 15° and 45°. In examples, the legs may be circumferentially smaller than the lugs, or circumferentially equal to the lugs (e.g., a 1:1 ratio), as required or desired.

The materials utilized in the manufacture of the lock and drive components described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.).

As used herein, the terms "axial" and "longitudinal" refer to directions and orientations, which extend substantially parallel to the longitudinal axis of the housing. Moreover, the terms "radial" and "radially" refer to directions and orientations, which extend substantially perpendicular to the longitudinal axis. In addition, as used herein, the terms "circumferential" and "circumferentially" refer to directions and orientations, which extend arcuately about longitudinal axis.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed:

1. An electronic deadbolt comprising:
- a housing;
- a deadbolt configured to extend or retract from the housing; and
- a drive system disposed at least partially within the housing, wherein the drive system comprises:
  - an electric motor;
  - a leadscrew coupled between the electric motor and the deadbolt, wherein the leadscrew is rotatable about a longitudinal axis so as to drive movement of the deadbolt; and
  - a flexible coupling disposed between the electric motor and the leadscrew, the flexible coupling comprising:
    - a drive hub comprising at least one drive lug;
    - a driven hub comprising at least one driven lug; and
    - a flexible collar disposed at least partially between the at least one drive lug and the at least one driven lug, wherein the flexible collar is positioned circumferentially between the at least one drive lug and the at least one driven lug relative to the longitudinal axis, and wherein the driven hub comprises a bore sized and shaped to at least partially receive the drive hub and the flexible collar.

2. The electronic deadbolt of claim 1, wherein the at least one drive lug and the at least one driven lug extend radially relative to the longitudinal axis.

3. The electronic deadbolt of claim 1, wherein the leadscrew has a first end and an opposite second end, and wherein the first end is threadingly coupled to the deadbolt and the second end comprises the driven hub.

4. The electronic deadbolt of claim 3, wherein the driven hub is integral with the second end of the leadscrew.

5. The electronic deadbolt of claim 1, wherein the drive hub comprises a pair of drive lugs of the at least one drive lug spaced approximately 180° apart and the driven hub comprises a pair of driven lugs of the at least one driven lug spaced approximately 180° apart.

6. The electronic deadbolt of claim 5, wherein the flexible collar comprises four legs, each disposed between a drive lug of the pair of drive lugs and a driven lug of the pair of driven lugs.

7. The electronic deadbolt of claim 1, wherein the housing defines the longitudinal axis.

8. The electronic deadbolt of claim 1, wherein the flexible coupling is configured to absorb torsional loads generated by the movement of the deadbolt.

9. A drive system for an electronic lock device comprising a locking element and a housing, wherein the drive system comprises:
- an electric motor;
- a rotatable shaft coupled to the electric motor and rotatable about a longitudinal axis;
- a drive hub coupled to the rotatable shaft;
- a driven hub rotationally engaged with the drive hub, wherein the drive hub is at least partially received within the driven hub;
- a leadscrew coupled to the driven hub, wherein upon rotation of the leadscrew the locking element extends or retracts from the housing; and
- a flexible collar disposed at least partially between the drive hub and the driven hub, wherein the flexible collar is configured to absorb torsional loads between the drive hub and the driven hub.

10. The drive system of claim 9, wherein the electric motor comprises at least one gear.

11. The drive system of claim 9, wherein the driven hub is integral with the leadscrew.

12. The drive system of claim 9, wherein the drive hub comprises a plurality of drive lugs and the driven hub comprises a plurality of driven lugs, wherein the flexible collar includes a plurality of legs and each leg is disposed between one drive lug of the plurality of drive lugs and one driven lug of the plurality of driven lugs.

13. The drive system of claim 12, wherein each leg is in direct contact with the drive lug and the driven lug.

14. The drive system of claim 12, wherein the plurality of legs are connected to one another.

15. The drive system of claim 9, wherein the electric motor, the rotatable shaft, and the leadscrew are axially aligned along the longitudinal axis.

16. An electronic lock device for a door or a window comprising:

a housing;

a locking element; and a drive system disposed at least partially within the housing and configured to extend or retract the locking element from the housing, wherein the drive system comprises:

an electric motor comprising one or more gears driving a rotatable shaft about a longitudinal axis;

a leadscrew coupled between the electric motor and the locking element, wherein the leadscrew is rotatable about the longitudinal axis so as to drive movement of the locking element; and a flexible coupling disposed between the electric motor and the leadscrew, wherein the flexible coupling comprises:

a drive hub comprising a pair of drive lugs coupled to the rotatable shaft;

a driven hub comprising a pair of driven lugs coupled to the leadscrew; and a flexible collar disposed at least partially between the drive hub and the driven hub.

17. The electronic lock device of claim 16, wherein the flexible coupling is axially aligned with the leadscrew and the electric motor along the longitudinal axis.

* * * * *